US006715531B2

(12) United States Patent
Simon

(10) Patent No.: US 6,715,531 B2
(45) Date of Patent: Apr. 6, 2004

(54) FLEXIBLE CURTAIN GUIDE MECHANISM UTILIZING DEFLECTING FRAME PLATES

(76) Inventor: Bernard Simon, 20, rue Jean-Baptiste Gaillard, F-69300 Caluire et Cuire (FR)

( * ) Notice: Subject to any disclaimer, the term of this patent is extended or adjusted under 35 U.S.C. 154(b) by 0 days.

(21) Appl. No.: 10/169,756

(22) PCT Filed: Jan. 12, 2001

(86) PCT No.: PCT/FR01/00098

§ 371 (c)(1),
(2), (4) Date: Sep. 9, 2002

(87) PCT Pub. No.: WO01/53648

PCT Pub. Date: Jul. 26, 2001

(65) Prior Publication Data

US 2003/0034135 A1 Feb. 20, 2003

(30) Foreign Application Priority Data

Jan. 20, 2000 (FR) ..... 00 00719

(51) Int. Cl.[7] ..... E06B 9/17
(52) U.S. Cl. ..... 160/271; 160/84.06
(58) Field of Search ..... 160/271, 273.1, 160/201, 84.01, 84.06, 264, 194; 16/94 R, 95 R, 96 R

(56) References Cited

U.S. PATENT DOCUMENTS 3,430,677 A * 3/1969 Pierce ..... 160/264
4,016,920 A 4/1977 Shepard
4,601,320 A * 7/1986 Taylor ..... 160/271
5,379,823 A * 1/1995 Kraeutler ..... 160/271
5,526,865 A 6/1996 Coenraets
5,887,385 A * 3/1999 Horner et al. ..... 160/201 X
6,192,960 B1 2/2001 Simon

FOREIGN PATENT DOCUMENTS

EP 0992650 4/2000
FR 2762642 10/1998

* cited by examiner

*Primary Examiner*—David Purol
(74) *Attorney, Agent, or Firm*—Greenblum & Bernstein, P.L.C.

(57) ABSTRACT

The invention also provides for a guide mechanism for guiding a flexible curtain in a door opening, wherein the guide mechanism includes first and second guide members arranged on at least one vertical side of the door opening. An extension is arranged at an upper end of each of the first and second guide members. A vertical track for guiding an edge of the flexible curtain is defined between the first and second guide members. A tapered expanded portion of the track is defined between the extensions of the first and second guide members. At least one of the first and second guide members includes a semirigid frame plate. The semirigid frame plate includes at least one wall which is capable of undergoing an elastic deformation under pressure of an external force and is capable of returning to an original position without damage. At least one of the extensions being elastically flexible and capable of deflecting out of an initial position.

22 Claims, 4 Drawing Sheets

FLEXIBLE CURTAIN GUIDE MECHANISM UTILIZING DEFLECTING FRAME PLATES

CROSS-REFERENCE TO RELATED APPLICATIONS

The present application is a National Stage Application of International Application No. PCT/IFR01/00098, filed Jan. 12, 2001. Further, the present application claims priority under 35 U.S.C. §119 of French Patent Application No. 00 00719 filed on Jan. 20, 2000.

BACKGROUND OF THE INVENTION

1. Field of the Invention

The present invention relates to a guide mechanism for a material handling door such as those used in industrial premises. The invention also includes a flexible curtain, horizontal stiffening crossbars and a driving system which allows rapid displacement of the flexible curtain between a closed position and an opened position.

2. Discussion of Background Information

According to French patent application no. 97 05305 (FR 2,762,642) in the name of the applicant, a guide mechanism is already known, which, on each opposite vertical post of the material handling door, is constituted by straps arranged facing each other to form guide tracks for the flexible curtain and for the horizontal stiffening crossbars.

The straps are each stretched and fixed between two extreme points joined together with the corresponding post such that each strap, under the pressure of an external force, can undergo an elastic deformation and return to its original position without damage.

SUMMARY OF THE INVENTION

The guide mechanism and the material handling door according to the present invention improves upon the strap-type guide mechanism by using semirigid frame plates made of a plastic or plastics material.

The guide mechanism according to the present invention is intended for use in material handling doors for industrial premises. The invention includes opposite vertical posts, a flexible curtain, horizontal stiffening crossbars and a driving system that allows rapid displacement of the flexible curtain between a closing or closed position and an opening or opened position. Each opposite post comprises semirigid frame plates which are fixed in a mutually facing arrangement so as to constitute, on each post, a guide track. The frame plates include at least one vertical wall which is capable of undergoing an elastic deformation and of returning to its original position without damage, under the pressure of an external force. The vertical wall of each frame plate includes an extension which is inclined toward the outside of the frame plates in order that the guide track has, in its upper part, a frustoconically flared profile. The extension of each vertical wall has a certain elastic flexibility in order to be able to deflect laterally relative to the wall and to the post.

The guide mechanism according to one aspect of the present invention comprises a frame plate having a first vertical wall connected by a veil to a second vertical wall.

The guide mechanism according to another aspect of the present invention comprises a frame plate having walls disposed in a vertical plane perpendicular to that containing the supporting face of the vertical post of the door.

The guide mechanism according to another aspect of the present invention comprises a frame plate having a wall of curved or inclined profile relative to the veil and to the supporting face of the post such as to constitute a flared-profile guide track.

The guide mechanism according to another aspect of the present invention comprises a frame plate having, on the outside of the profile section and over the full height of the walls, lips disposed respectively at the level of the junction between the walls and the veil to ensure sealing tightness between the frame plates and the supporting face of the post of the door.

The guide mechanism according to another aspect of the present invention comprises lips applied to the profile of the frame plates by coextrusion in a plastics material different from that of the frame plates.

The guide mechanism according to another aspect of the present invention comprises a frame plate having a first vertical wall which is greater in width than the second vertical wall.

The guide mechanism according to another aspect of the present invention comprises an extension situated above the last point of attachment of each frame plate to the supporting face of each post.

The material handling door for industrial premises according to the present invention comprises opposite vertical posts, a flexible curtain, horizontal stiffening crossbars, a driving system which allows rapid displacement of the flexible curtain between a closing position and an opening position. Semirigid frame plates are fixed or arranged in mutually facing arrangement so as to constitute on each post a guide track for the flexible curtain and for the horizontal crossbars. The frame plates include at least one vertical wall which is capable of undergoing an elastic deformation and of returning to its original position without damage, under the pressure of an external force. The vertical wall of each frame plate includes an extension which is inclined toward the outside of the frame plates in order that the guide track has, in its upper part, a frustoconically flared profile. The extension of each vertical wall has a certain elastic flexibility in order to be able to deflect laterally relative to the wall and to the post.

The material handling door for industrial premises according to the present invention can include a frame plate having a first vertical wall connected by a veil to a second vertical wall.

The material handling door for industrial premises according to the present invention can include a frame plate having walls disposed in a vertical plane perpendicular to that containing the veil and the supporting face of the vertical post of the door.

The material handling door for industrial premises according to the present invention can include a frame plate having a wall with a curved or inclined profile relative to the veil and to the supporting face of the post such as to constitute a flared-profile guide track.

The material handling door for industrial premises according to the present invention can include a frame plate having, on the outside of the profile section and over the full height of the walls, lips disposed respectively at the level of the junction between the walls and the veil to ensure sealing tightness between the frame plates and the supporting face of the post of the door.

The material handling door for industrial premises according to the present invention can include a frame plate having a first vertical wall which is greater in width than the second vertical wall.

The material handling door for industrial premises according to the present invention can include lips applied to the profile of the frame plates by coextrusion in a plastic or plastics material different from that of the frame plates.

The material handling door for industrial premises according to the present invention can include an extension situated above the last point of attachment of each frame plate to the supporting face of each post.

The invention also provides for a guide mechanism for guiding a flexible curtain in a door opening, wherein the guide mechanism comprises first and second guide members arranged on at least one vertical side of the door opening. An extension is arranged at an upper end of each of the first and second guide members. A vertical track for guiding an edge of the flexible curtain is defined between the first and second guide members. A tapered expanded portion of the track is defined between the extensions of the first and second guide members. At least one of the first and second guide members comprises a semirigid frame plate. The semirigid frame plate comprises at least one wall which is capable of undergoing an elastic deformation under pressure of an external force and is capable of returning to an original position without damage. At least one of the extensions being elastically flexible and capable of deflecting out of an initial position.

The tapered expanded portion of the track may comprise a frustoconically flared profile. At least one of the extensions may have a certain elastic flexibility so as to be able to deflect laterally relative to a vertical side of the door opening. The door may comprise a material handling door for an industrial premises. The door may comprise two opposite vertical posts, the flexible curtain, horizontal stiffening crossbars and a driving system for allowing rapid displacement of the flexible curtain between a closed position and an opened position. The semirigid frame plate may further comprise a veil and an other vertical wall. The veil may connect the at least one vertical wall to the other vertical wall. Each of the first and second guide members may comprise the semirigid frame plate. Each of the semifigid frame plates may comprise at least two walls which extend in a direction that is perpendicular to an inside face of the door opening. The at least one wall may be one of curved and inclined relative to a plane which extends in a direction that is perpendicular to an inside face of the door opening.

At least one of the first and second guide members may comprise at least one lip. The at least one lip may be arranged on an inside part of at least one of the first and second guide members. The at least one lip may be arranged on an outside part of at least one of the first and second guide members. The at least one lip may comprise two lips arranged on each of an inside and an outside part of at least one of the first and second guide members. The guide mechanism of claim 20, wherein the at least one lip ensures sealing tightness between at least one of the first and second guide members and a supporting face of the door opening. The at least one lip may be connected to the at least one semirigid frame plate. The at least one lip may be coextruded to the at least one semirigid frame plate. The at least one lip may comprise a first plastic and wherein the at least one semirigid frame plate comprises a second plastic, the first plastic being different from the second plastic. The at least one wall of the semirigid frame plate may comprise two walls. One of the two walls may comprise a first width and another of the walls comprises a second width, the first width being greater than the second width.

The invention also provides for a flexible curtain guide mechanism for a door opening comprising first and second guide members arranged on two vertical sides of the door opening. A flexibly movable extension is arranged at an upper end of each first and second guide members. A vertical track for guiding an edge of the flexible curtain is defined between the first and second guide members. A tapered expanded portion of the track is defined between the flexibly movable extensions of the first and second guide members. At least one of the first and second guide members comprises a semirigid frame plate. Each semirigid frame plate comprises at least one wall which is capable of undergoing an elastic deformation under pressure of an external force and is capable of returning to an original position without damage. Each of the extensions is elastically flexible and capable of deflecting out of an initial position.

The invention also provides for a flexible curtain door having a flexible curtain guide mechanism arranged on a door opening comprising first and second guide members arranged on each of two vertical sides of the door opening. A flexibly movable extension is arranged at an upper end of each first and second guide members. A vertical track for guiding an edge of the flexible curtain is defined between the first and second guide members. The flexible curtain has edges that are arranged to move in the vertical tracks. A tapered expanded portion of the track is defined between the flexibly movable extensions of the first and second guide members. At least one of the first and second guide members comprises a semirigid frame plate. Each semirigid frame plate comprises at least one wall which is capable of undergoing an elastic deformation under pressure of an external force and is capable of returning to an original position without damage. Each of the extensions is elastically flexible and capable of deflecting out of an initial position.

BRIEF DESCRIPTION OF THE DRAWINGS

The following description with reference to the appended drawings, given by way of non-limiting examples, will allow a better understanding of the invention, its characteristics and the advantages, wherein.

DETAILED DESCRIPTION OF THE INVENTION

Figure 1:
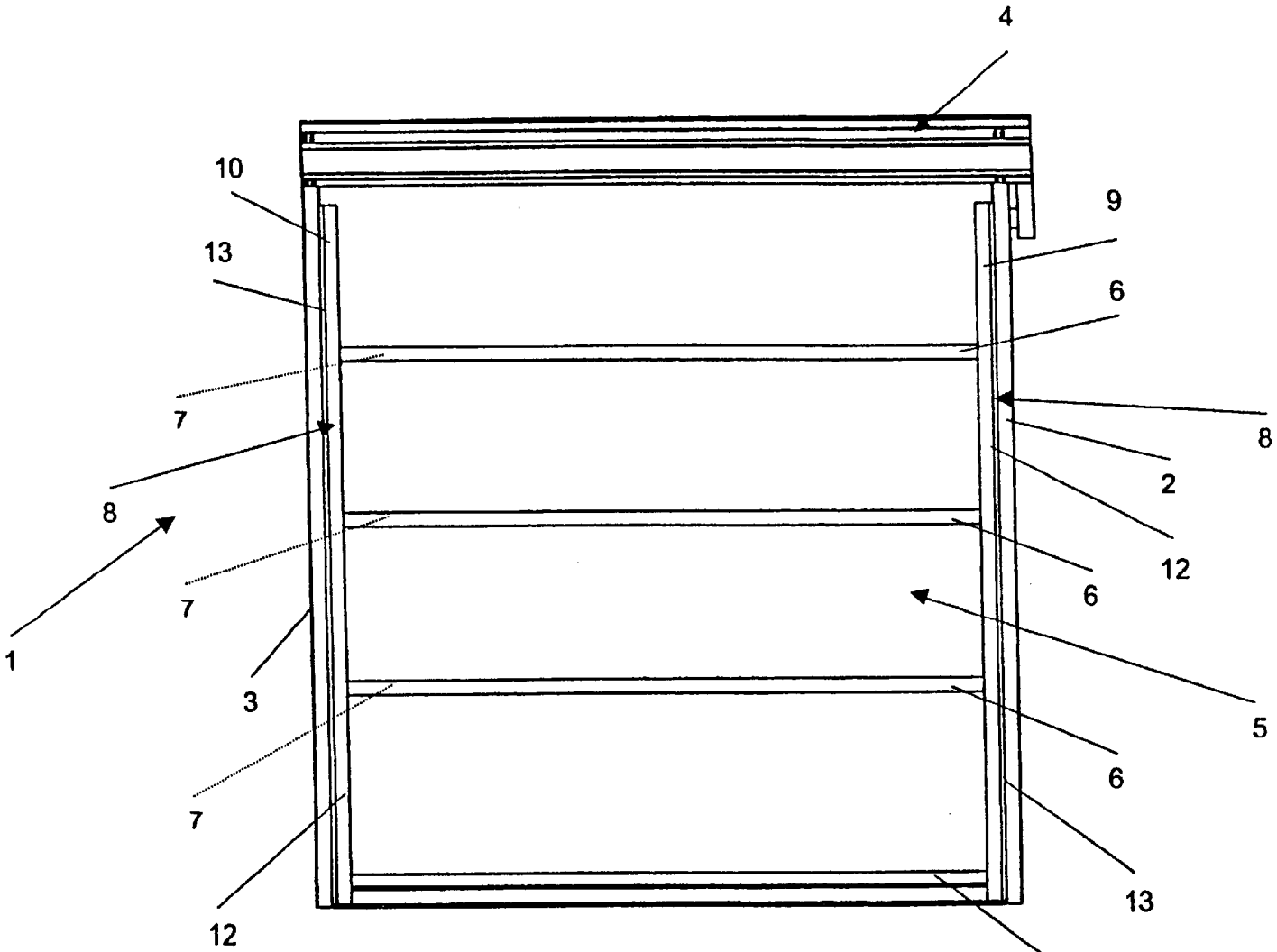
FIG. 1 is a front view showing a door with flexible winding curtain, provided with a guide mechanism according to the present invention.
Figure 2A:
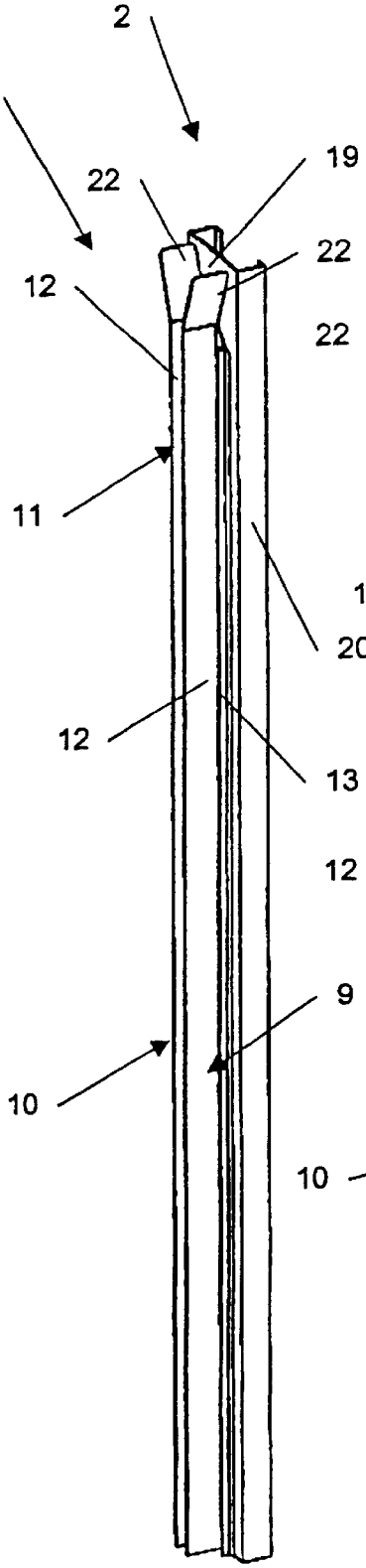
FIGS. 2*a* and 2*b* are perspective views illustrating the semirigid frame plates of the guide mechanism according to the present invention.
Figure 2B:
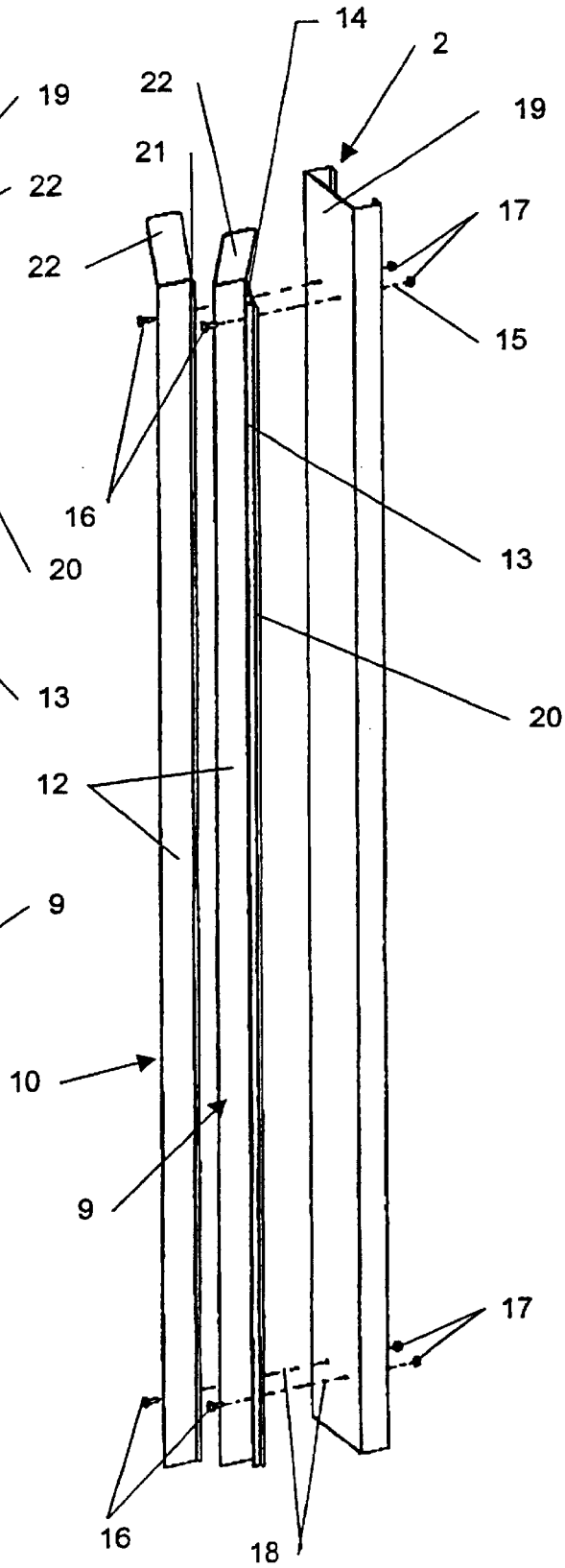
Figure 3:
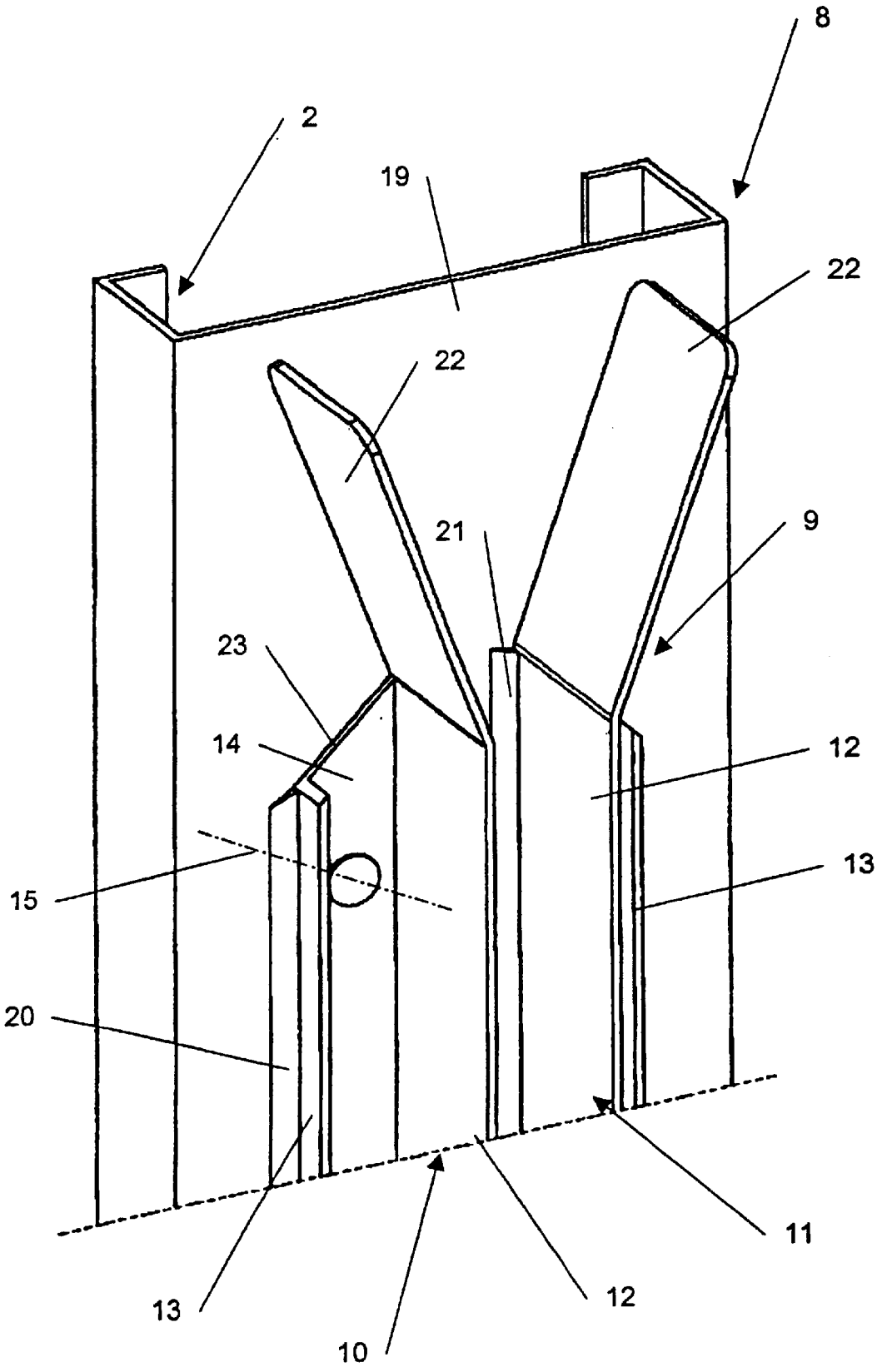
FIG. 3 is a perspective view showing in detail the flared profile of the upper part of each semirigid frame plate of the guide mechanism according to the invention.

FIGS. 1 to 3 illustrate a material handling door 1 comprising two lateral posts 2 and 3, which are generally fixed to the vertical walls of an opening to be blocked. The opposite vertical posts 2 and 3 are mutually connected in the upper part of the door 1 by a winding drum 4 for a flexible curtain 5.

It can be seen that the flexible curtain 5 comprises sheaths 6 in which reinforcing horizontal crossbars 7 are introduced, the ends of which cooperate with a guide mechanism 8 provided on each post 2 and 3.

Thus, the posts 2 and 3 are joined together with a guide mechanism 8 allowing the flexible curtain 5 to move between a closing position and an opening position. Each guide mechanism 8 comprises two semirigid frame plates 9 and 10, arranged facing each other so as to constitute on each post 2 and 3, and over the full height of the latter, a track 11 for the guidance of the curtain 5 and of the horizontal crossbars 7.

For the sake of clarity and understanding, only the guide mechanism 8 provided on the post 2 will be described, given that the other guide mechanism arranged on the post 3 is identical.

FIGS. 2*a* and 2*b* show the frame plates 9, 10 of the guide mechanism 8, which are provided on the post 2 and are realized in a L-shaped or U-shaped profile, comprising elastic properties sufficient to be able to curve or deform when an external force is applied either to the flexible curtain 5 or to the guide mechanism 8.

Each frame plate 9, 10 has a first vertical wall 12, connected to a second vertical wall 13 by a veil 14 disposed in a plane substantially perpendicular to the walls.

The vertical wall 12 of each frame plate 9, 10 can be disposed in a plane perpendicular to the veil 14 and to the supporting face 19 of the vertical post 2 of the door 1, though this is not essential.

By way of a variant, the vertical wall 12 of each frame plate 9, 10 can have a curved or inclined profile relative to the veil 14 and to the supporting face 19 of the vertical post 2.

The vertical wall 12 of each frame plate 9, 10 of curved or inclined profile is directed toward the vertical wall 13 so as to define with the wall 12 of the other frame plate a track 11 of flared profile over its full height.

Thus, the vertical wall 12 of each frame plate 9, 10 is previously curved or inclined, at the time of its manufacture, in a direction identical to that of its possible deformation when an external force is applied either to the flexible curtain 5 or to the guide mechanism 8.

The wall 13 is disposed in a vertical plane perpendicular to that containing the supporting face 19 of the vertical post 2 of the door 1.

The frame plates 9 and 10 have on the outside of the profile section, and over the full height of the walls 12 and 13, lips 20 and 21, disposed at the level of the junction between the walls and the veil 14.

The lips 21 and 21 ensure imperviousness to dusts between the frame plates 9, 10 and the supporting face 19 of the post 2 of the door 1. The lips 20 and 21 can be applied to the profile of the frame plates 9, 10 by coextrusion in a plastic or plastics material different from that of the frame plates, which is more flexible and which ensures better sealing tightness between the frame plates and the supporting face 19 of the post 2.

The frame plates 9 and 10 are held on the post 2 in such a way that each vertical wall 12 is placed in a mutually facing arrangement so as to constitute the guide track 11, whilst each veil 14 rests against the supporting face 19 of the post.

It can be seen that the wall 12 of each frame plate 9, 10 has, relative to the veil 14, a greater width than that of the vertical wall 13, allowing better guidance of the flexible curtain 5 and of the crossbars 7 at times of displacements.

Each frame plate 9 and 10 is held in its upper section on the post 2 by a fixing axle 15, which is constituted by a bolt 16 passing through the veil 14 and the supporting face of the post, and a nut 17 cooperating with the threaded part of the bolt.

Opposite the axle 15, the lower parts of the frame plates 9 and 10 are kept at a distance apart by another fixing axle 18 identical to the axle 15 and held joined together with the post 2.

It can be seen that the number of axles for fixing the frame plates 9 and 10 to the post 2 can vary as a function of the height of the posts and the rigidity of the connection to be obtained.

FIG. 3 shows the upper part of the frame plates 9, 10, joined together with the vertical post 2, each wall 12 of which frame plates each have an extension 22 which is inclined relative to the wall toward the outside of each frame plate.

The extension 22 is obtained at the time of manufacture of each frame plate 9, 10 such that the guide track 11, when the frame plates are fixed in a mutually facing arrangement to the post 2 in its upper part, has a frustoconically flared profile.

Thus, each extension 22 is inclined toward the outside of each frame plate 9, 10 relative to the corresponding wall 12 so as to facilitated the reintroduction of the flexible curtain 5 inside the guide track 11 after having been taken down.

Each extension 22 has a certain elastic flexibility so as to be able to deflect laterally relative to the wall 12 and to the post 2 so that the flexible curtain 5 can be introduced from the outside toward the inside of the track 11.

It can be seen that the greater the length of the extension 22, that is to say the more the extension 22 extends above the wall 12, the more its flexibility is increased and the easier it becomes to reintroduce the horizontal stiffening crossbars 7 and the flexible curtain 5 inside the guide track 11.

The extensions 22 of each wall 12 are situated above the last upper fixing axle 15, so that each frame plate 9, 10 can be held against the supporting face 19 of the post 2 of the door 1.

It is apparent that the veil 14 has an inclined face or edge 23, the highest part of which is located at the level of the connecting line between the extension 22 and the wall 12.

Thus, the height of the wall 13, connecting to the level of the lowest part of the inclined face 23 of the veil 14, is less then that of the wall 12, facilitating the arrival of elements for guiding the flexible curtain 5 against the extension 22 when these are located outside the track 11.

Moreover, the inclined face 23 prevents any tearing and damaging of the guide elements for the flexible curtain 5 when it is reintroduced into the guide track 11.

Figure 4:
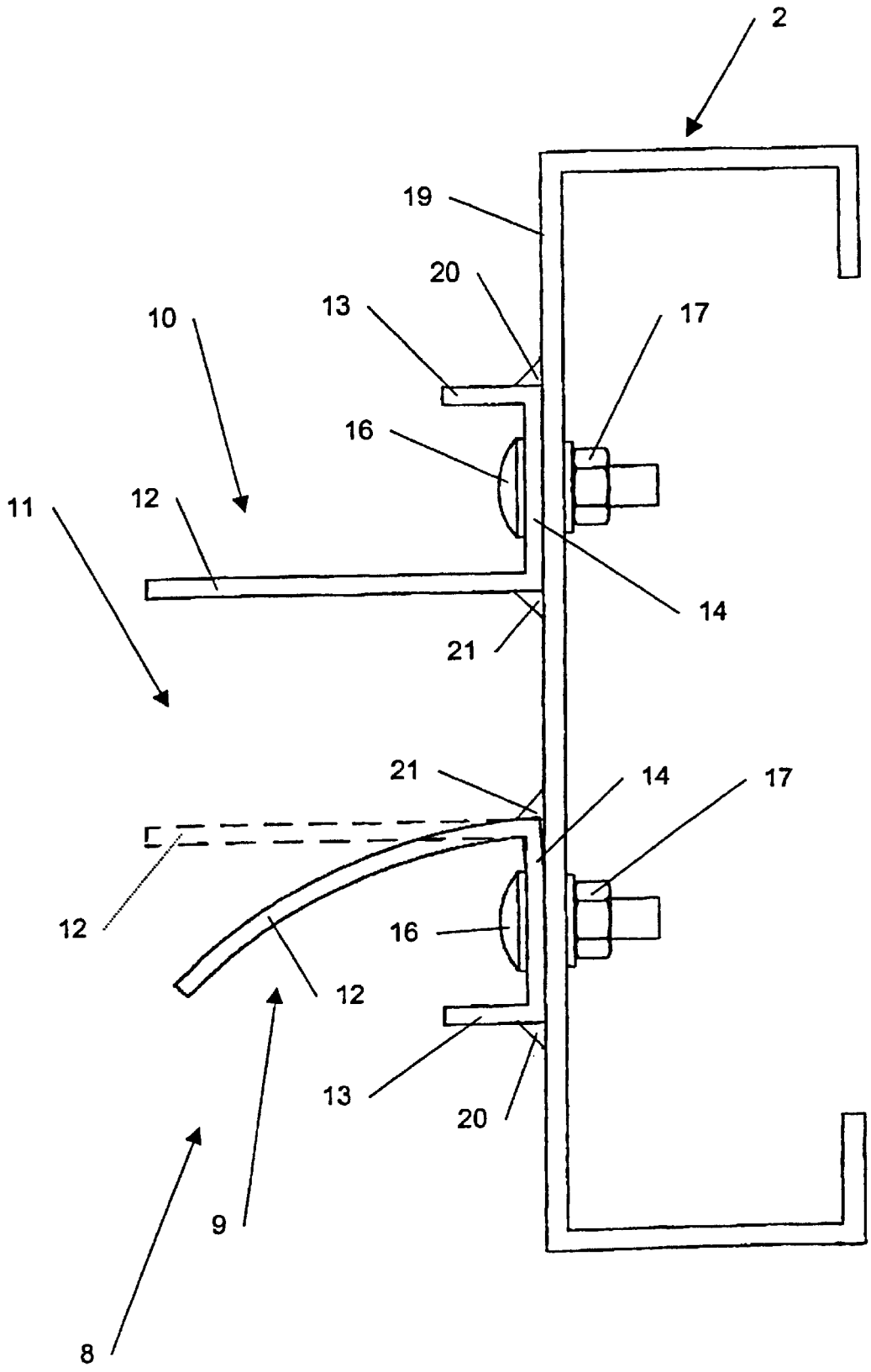
FIG. 4 is a view representing the elastic deformation, under an external force, of a semirigid frame plate of the guide mechanism according to the present invention.

FIG. 4 illustrates, for example, the elastic deformation of the vertical wall 12 relative to the veil 14 joined together with the post 2 of the frame plate 9 when an external pressure force is applied to the flexible curtain 5.

It can be seen that only the vertical wall 12, which is straight, curved or inclined relative to the veil 14 and over the full height of the frame plate 9, undergoes an elastic deformation, which is directed in a direction similar to that of the external pressure force.

The elastic deformation of the wall 12, which wall is straight, curved or inclined relative to the veil 14, is generally directed toward the outside of the track 11 so that the horizontal stiffening crossbars 7 and the flexible curtain 5 can be taken down.

When the wall 12 has a curved or inclined profile relative to the veil 14, the elastic deformation is directed in the extension of the curved or inclined profile so as to facilitated the expulsion of the horizontal stiffening crossbars 7 and the flexible curtain 5 from the track 11.

It is evident that the material used for each frame plate 9 and 10 allows the wall 12 to undergo an elastic deformation under the pressure of an external force and to return to its original position without damage.

In fact, the elastic deformation of the frame plates 9 and 10 in the event of a jamming of the flexible curtain 5 or a lateral shock, for example, allows the horizontal stiffening crossbars 7 to be taken down without risk of damage thereto and to the frame plates.

In all cases, the wall 12 of each frame plate 9, 10 must be capable of deforming and of achieving a deflection of determined value without suffering plastic deformation. It will be easily understood that the value of the deflection is given as a function of the mechanical properties of the material and of the profile of the frame plate 9, 10.

It will also be apparent that the material used for the frame plates 9 and 10 prevents the formation and adherence of ice when the material handling doors are used to isolate rooms whose internal temperatures are different.

For example, the material used for the manufacture of the frame plates 9 and 10 can belong to the polyethylenes family.

It is evident that the distance between the frame plates 9 and 10 arranged facing each other on each post 2, 3 can vary in order to present a guide track 11 of greater or lesser width.

It can be seen that when the distance between the frame plates 9 and 10 is large, the horizontal stiffening crossbars 7 and the flexible curtain 5, upon application of an external force, are easy to take down from the track 11.

Conversely, the smaller the distance exhibited by the track 11 between its frame plates 9 and 10, the more difficult it becomes to expel the horizontal stiffening crossbars 7 and the flexible curtain 5 with the application of an external force.

It must be understood, moreover, that the preceding description has only been presented by way of example and which in no way limits the scope of the invention, which would not be transgressed if the described execution details were replaced by any other equivalent.

What is claimed is:

1. A guide mechanism for guiding a flexible curtain in a door opening, the guide mechanism comprising:

first and second guide members arranged on at least one vertical side of the door opening;

an extension arranged at an upper end of each of the first and second guide members;

a vertical track for guiding an edge of the flexible curtain being defined between the first and second guide members;

a tapered expanded portion of the track being defined between the extensions of the first and second guide members;

at least one of the first and second guide members comprising a semirigid frame plate;

the semirigid frame plate comprising at least one wall which is capable of undergoing an elastic deformation under pressure of an external force and is capable of returning to an original position without damage; and at least one of the extensions being elastically flexible and capable of deflecting out of an initial position.

2. The guide mechanism of claim 1, wherein the tapered expanded portion of the track comprises a frustoconically flared profile.

3. The guide mechanism of claim 1, wherein at least one of the extensions has a certain elastic flexibility so as to be able to deflect laterally relative to a vertical side of the door opening.

4. The guide mechanism of claim 1, wherein the door comprises a material handling door for an industrial premises.

5. The guide mechanism of claim 1, wherein the door comprises two opposite vertical posts, the flexible curtain, horizontal stiffening crossbars and a driving system for allowing rapid displacement of the flexible curtain between a closed position and an opened position.

6. The guide mechanism of claim 1, wherein the semirigid frame plate further comprises a veil and an other vertical wall.

7. The guide mechanism of claim 1, wherein the veil connects the at least one vertical wall to the other vertical wall.

8. The guide mechanism of claim 1, wherein each of the first and second guide members comprises the semirigid frame plate.

9. The guide mechanism of claim 8, wherein each of the semifigid frame plates comprises at least two walls which extend in a direction that is perpendicular to an inside face of the door opening.

10. The guide mechanism of claim claim 1, wherein the at least one wall is one of curved and inclined relative to a plane which extends in a direction that is perpendicular to an inside face of the door opening.

11. The guide mechanism of claim 1, wherein at least one of the first and second guide members comprises at least one lip.

12. The guide mechanism of claim 11, wherein the at least one lip is arranged on an inside part of at least one of the first and second guide members.

13. The guide mechanism of claim 11, wherein the at least one lip is arranged on an outside part of at least one of the first and second guide members.

14. The guide mechanism of claim 11, wherein the at least one lip comprises two lips arranged on each of an inside and an outside part of at least one of the first and second guide members.

15. The guide mechanism of claim 11, wherein the at least one lip ensures sealing tightness between at least one of the first and second guide members and a supporting face of the door opening.

16. The guide mechanism of claim 11, wherein the at least one lip is connected to the at least one semirigid frame plate.

17. The guide mechanism of claim 11, wherein the at least one lip is coextruded to the at least one semirigid frame plate.

18. The guide mechanism of claim 11, wherein the at least one lip comprises a first plastic and wherein the at least one semirigid frame plate comprises a second plastic, the first plastic being different from the second plastic.

19. The guide mechanism of claim 1, wherein the at least one wall of the semirigid frame plate comprises two walls.

20. The guide mechanism of claim 19, wherein one of the two walls comprises a first width and another of the walls comprises a second width, the first width being greater than the second width.

21. A flexible curtain guide mechanism for a door opening comprising:

first and second guide members arranged on two vertical sides of the door opening;

a flexibly movable extension arranged at an upper end of each first and second guide members;

a vertical track for guiding an edge of the flexible curtain being defined between the first and second guide members;

a tapered expanded portion of the track being defined between the flexibly movable extensions of the first and second guide members;

at least one of the first and second guide members comprising a semirigid frame plate;

each semirigid frame plate comprising at least one wall which is capable of undergoing an elastic deformation under pressure of an external force and is capable of returning to an original position without damage; and each of the extensions being elastically flexible and capable of deflecting out of an initial position.

22. A flexible curtain door having a flexible curtain guide mechanism arranged on a door opening comprising:

first and second guide members arranged on each of two vertical sides of the door opening;

a flexibly movable extension arranged at an upper end of each first and second guide members;

a vertical track for guiding an edge of the flexible curtain being defined between the first and second guide members;

the flexible curtain having edges that are arranged to move in the vertical tracks;

a tapered expanded portion of the track being defined between the flexibly movable extensions of the first and second guide members;

at least one of the first and second guide members comprising a semirigid frame plate;

each semirigid frame plate comprising at least one wall which is capable of undergoing an elastic deformation under pressure of an external force and is capable of returning to an original position without damage; and each of the extensions being elastically flexible and capable of deflecting out of an initial position.

* * * * *